US007385132B2

(12) United States Patent
Komano et al.

(10) Patent No.: US 7,385,132 B2
(45) Date of Patent: Jun. 10, 2008

(54) ELECTRONIC MUSIC APPARATUS AND MUSIC-RELATED DATA DISPLAY METHOD

(75) Inventors: Takeshi Komano, Iwata (JP); Hiroki Nakazono, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 161 days.

(21) Appl. No.: 11/230,762

(22) Filed: Sep. 19, 2005

(65) Prior Publication Data

US 2006/0060066 A1 Mar. 23, 2006

(30) Foreign Application Priority Data

Sep. 22, 2004 (JP) ..... 2004-275358
Sep. 22, 2004 (JP) ..... 2004-275359

(51) Int. Cl.
*G10H 7/00* (2006.01)
*G10H 1/00* (2006.01)
*G10H 1/18* (2006.01)

(52) U.S. Cl. ..... 84/615; 84/605; 84/653; 84/477 R

(58) Field of Classification Search ..... None
See application file for complete search history.

(56) References Cited

U.S. PATENT DOCUMENTS 5,808,223 A 9/1998 Kurakake et al.
6,206,704 B1 3/2001 Tsai
6,321,383 B1 11/2001 Funahashi et al.
6,374,260 B1 4/2002 Hoffert et al.
6,429,366 B1 8/2002 Terada
6,928,423 B1 * 8/2005 Yamanaka ..... 705/50
2002/0163533 A1 11/2002 Trovato et al.
2004/0092226 A1 * 5/2004 Tsutsui et al. ..... 455/12.1
2005/0058319 A1 * 3/2005 Rhoads et al. ..... 382/100
2006/0209448 A1 * 9/2006 Hirano et al. ..... 360/69

FOREIGN PATENT DOCUMENTS

EP 0911830 4/1999

* cited by examiner

*Primary Examiner*—Marlon T Fletcher
(74) *Attorney, Agent, or Firm*—Morrison & Foerster LLP

(57) ABSTRACT

There are provided a first storage section that stores text files each including at least text data, and a second storage section that stores registration data including predetermined performance environment setting information and text file selection information specifying a text file associated with a performance environment set on the basis of the performance environment setting information. Registration data is selected from the second storage section, and the text file associated with the performance environment is selected, in accordance with the text file selection information of the selected registration data, from among the text files stored in the first storage section. The text data included in the selected text file is displayed on the basis of the selected text file. In an alternative, control is performed to display lyrics data included in currently-reproduced automatic performance data or text data included in the text file stored in the first storage section.

17 Claims, 8 Drawing Sheets

ELECTRONIC MUSIC APPARATUS AND MUSIC-RELATED DATA DISPLAY METHOD

BACKGROUND OF THE INVENTION

The present invention relates generally to electronic music apparatus, methods and programs capable of displaying various information, such as lyrics, in response to reproduction of performance data. More particularly, the present invention relates to an improved electronic music apparatus, method and program which allow a user to readily select a user-created text data file containing various information. The present invention also relates to an improved electronic music apparatus, method and program which, during reproduction of performance data, can display lyrics based on a lyrics data file and display various information based on a user-created text file while switching as necessary between the lyrics and the text-file information.

Apparatus have been known which are constructed to prestore lyrics data along with performance data forming a basis of an automatic performance and display lyrics of a music piece, to be automatically performed by reproduction of the performance data, on the basis of the lyrics data. One example of such apparatus is disclosed in Japanese Patent Application Laid-open Publication No. HEI-9-152876 corresponding to U.S. Pat. No. 5,808,223. In the disclosed apparatus, lyrics data are embedded in performance data so that lyrics corresponding to a currently-automatically-performed music piece can be displayed in accordance with reproduction of the performance data. The disclosed apparatus is also constructed to, instead of embedding lyric data in performance data, prepare in advance a lyrics data file separately from a performance file with a same file name, but different file extensions, allocated to both of the files so as to associate the performance data and lyrics data with each other, so that the apparatus can read out lyrics corresponding to a currently-automatically-performed music piece by reading out the lyrics data associated with the currently-reproduced performance data.

However, the prior art publication merely discloses lyrics data for displaying lyrics corresponding to a currently-automatically-performed music piece, and it does not contain any particular disclosure of, or give any particular consideration to, non-lyrics data for displaying various other information than lyrics (e.g., memos about how to operate an electronic music apparatus and how to play music, and what is to be the by a singer on the stage). Thus, it is conceivable to prepare in advance a non-lyrics data file separately from a performance file similarly to the above-mentioned lyrics data file (or previously embed non-lyrics data in performance data), and display for example various other information than lyrics, pertaining to a music piece automatically performed by reproduction of the performance data, on the basis of the prepared non-lyrics data file (or embedded non-lyrics data). However, each conventionally-known lyrics data file is in a dedicated format where combinations of "time data" indicative of timing for displaying individual words and "lyrics event data" indicative of words to be displayed are arranged in time series. Thus, it tends to be very difficult for a user, who is unfamiliar with such a dedicated format, to create a non-lyrics data file (or embed non-lyrics data) with similar arrangements to a lyrics data file using a personal computer or the like. Further, because, in order to associate non-lyrics data with performance data, there is a significant constraint that the non-lyrics data file be assigned a file name having some relationship with a file name assigned to the performance file, the user can not create in advance a non-lyrics data file with a desired file name assigned thereto. Further, the conventional technique could not display various other information than lyrics on a display of the electronic music apparatus although the user so desired; thus, for display of various other information than lyrics, there was no choice but to, for example, take notes of the information on a piece of paper or the like and attach the paper or the like to the electronic music apparatus.

SUMMARY OF THE INVENTION

In view of the foregoing, it is an object of the present invention to provide an electronic music apparatus, method and program which can readily select a user-created text data file of a desired file name and display contents of the selected text data file, by previously including text file selection information in a registration data file and allowing a text data file to be selected in response to selection of the registration data file.

It is another object of the present invention to provide an electronic music apparatus, method and program which, during reproduction of performance data including lyrics data indicative of lyrics, permit a display of lyrics based on a lyrics data file and a display of various information based on a user-created text data file, including various desired information, while switching as necessary between the displays of the lyrics and various information.

The present invention provides an improved electronic music apparatus, which comprises: a first storage section that stores text files each including at least text data; a second storage section that stores registration data including predetermined performance environment setting information and text file selection information specifying a text file associated with a performance environment set on the basis of the performance environment setting information; a selection section that selects registration data from the second storage section; a text selection section that, in accordance with the text file selection information of the selected registration data, selects the text file associated with the performance environment from among the text files stored in the first storage section; and a display section that, on the basis of the selected text file, displays the text data included in the selected text file.

According to the present invention, in response to selection of registration data from the second storage section, a user-created text file text file is automatically selected which is associated with a performance environment set by the performance environment setting information of the selected registration data. Namely, in the second storage section, there are stored registration data including predetermined performance environment setting information and text file selection information specifying a text file associated with a performance environment set on the basis of the performance environment setting information, and any desired one of the registration data can be selected. In accordance with the selected registration data, the text selection section selects the text file associated with the performance on the basis of the text file selection information. On the basis of the selected text file, the display section displays the text data included in the selected text file. Namely, in the registration data, the performance environment setting information and any one of the stored text files are associated with each other by the text file selection information. Because of such arrangements, the user is allowed to use a personal computer etc. to create, as a text file, various information to be displayed during an automatic performance, and, by only selecting registration data, the user can readily select and display a user-created text file containing various information (text data) fitting a desired performance environment.

According to another aspect of the present invention, there is provided an electronic music apparatus, which comprises: a first storage section that stores text files each including at least text data; a second storage section that stores registration data including predetermined performance data specifying information and text file selection information specifying a text file associated with automatic performance data specified on the basis of the performance data specifying information; a selection section that selects registration data from the second storage section; a text selection section that, in accordance with the text file selection information of the selected registration data, selects the text file associated with the automatic performance data from among the text files stored in the first storage section; and a display section that, on the basis of the text file selected via the text selection section, displays the text data included in the selected text file. Because the automatic performance data specified on the basis of the performance data specifying information in the registration data and any one of the stored text files is associated with each other by the text file selection information, the text selection section can select a text file of contents associated with the automatic performance data in response to selection of the registration data, which thereby permits selection of a user-created text file associated with automatic performance data, so that various information pertaining to an automatically-performed music piece can be readily displayed on the basis of the selected text file.

According to still another aspect of the present invention, there is provided an electronic music apparatus capable of communicating with an external device that stores text files each including at least text data, which comprises: a storage section that stores registration data including predetermined performance environment setting information and text file selection information specifying a particular one of the text files, stored in the external device, which is associated with a performance environment set on the basis of the performance environment setting information; a selection section that selects the registration data from the storage section; a communication section that communicates with the external device; a text acquisition section that, in accordance with the text file selection information of the registration data selected via the selection section, acquires any one of the text files stored in the external device; and a display section that, on the basis of the text file acquired by the text acquisition section, displays the text data included in the acquired text file. With such arrangements, a Web page or the like stored in the external device can be displayed on the electronic music apparatus.

According to still another aspect of the present invention, there is provided an electronic music apparatus, which comprises: a first storage section that stores text files each including at least text data; a second storage section that stores automatic performance data including lyrics data; a reproduction section that reproduces the automatic performance data stored in the second storage section; a display section; and a display switching section that performs control to display, on the display section, the lyrics data included in the automatic performance data being reproduced by the reproduction section or the text data included in the text file stored in the first storage section.

The present invention thus arranged can display, during reproduction of automatic performance data, lyrics data or text data on the display section while switching as necessary between the displays of the lyrics data and text data. Text file including at least text data and automatic performance data including lyrics data are prestored separately from each other, and an automatic performance is executed by reproducing any of the automatic performance data. The display section can display lyrics of an automatically-performed music piece on the basis of the lyrics data included in the automatic performance data being reproduced, or various user-created information on the basis of the stored text file. During reproduction of the automatic performance data, the display switching section controls the display section to display the lyrics data or text data. In this way, the user can prestore a text file containing various information, other than lyrics, created using a personal computer etc. and thus, during reproduction of automatic performance data, can readily cause the lyrics and various user-created information other than the lyrics to be readily displayed while switching as necessary between the displays of the lyrics and various user-created information.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
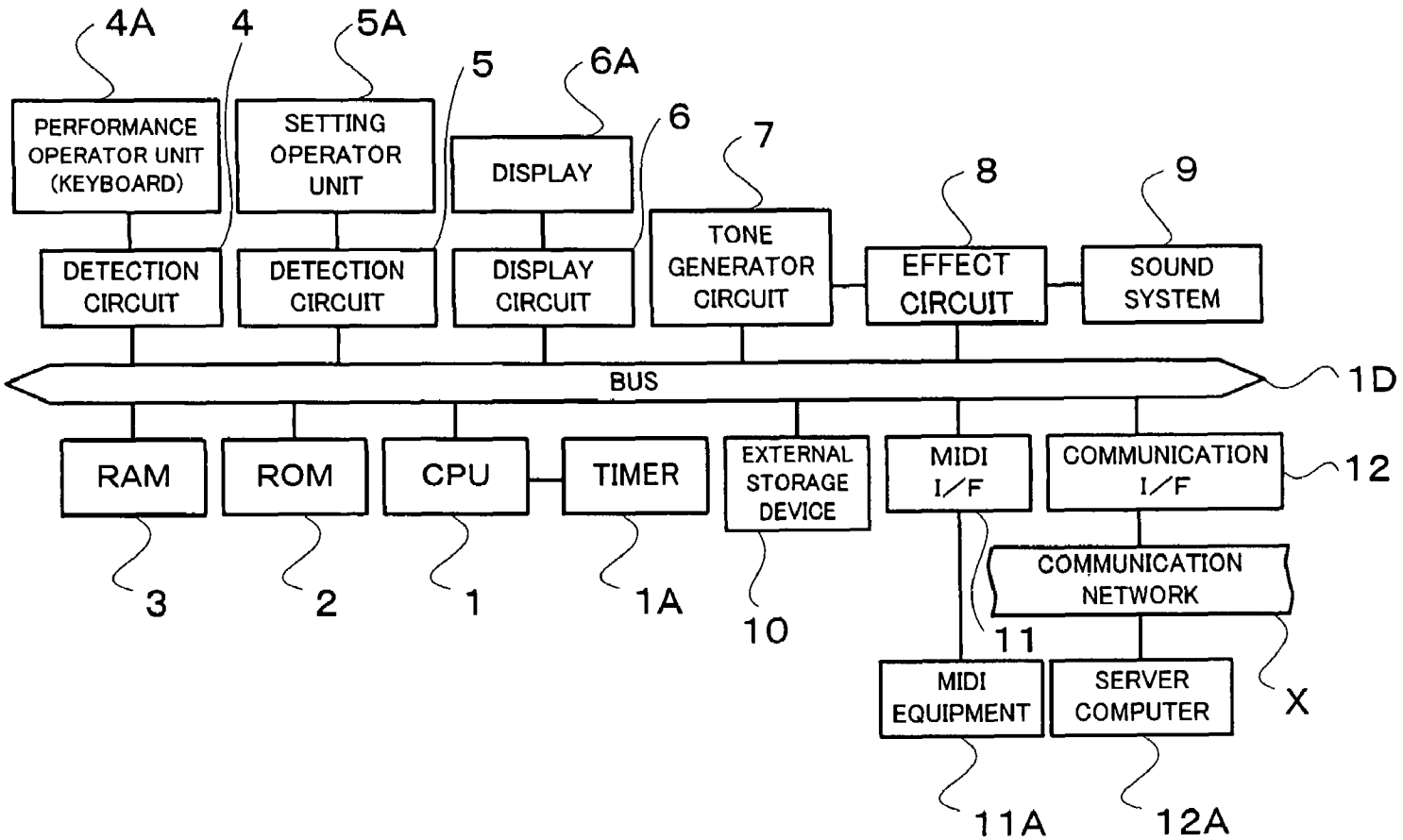
FIG. 1 is a block diagram illustrating a general hardware setup of an electronic music apparatus in accordance with an embodiment of the present invention.

FIG. 1 is a block diagram illustrating a general hardware setup of an electronic music apparatus in accordance with an embodiment of the present invention. This electronic music apparatus is controlled by a microcomputer comprising a microprocessor unit (CPU) 1, a read-only memory (ROM) 2 and a random-access memory (RAM) 3. The CPU 1 controls behavior of the entire electronic music apparatus. To the CPU 1 are connected, via a data and address bus 1D, the ROM 2, RAM 3, detection circuits 4 and 5, display circuit 6, tone generator (T.G.) circuit 7, effect circuit 8, external storage device 10, MIDI interface (I/F) 11 and communication interface 12. Also connected to the CPU 1 is a timer 1A for counting various time periods and intervals, for example, to signal interrupt timing for a timer interrupt process. For example, the timer 1A generates clock pulses, which are given to the CPU 1 as processing timing instructions or as interrupt instructions. The CPU 1 carries out various processes in accordance with such instructions.

The ROM 2 has prestored therein various programs to be executed by the CPU 1 and various data. The RAM 3 is used as a working memory for temporarily storing various data generated as the CPU 1 executes a predetermined program, as a memory for storing the currently-executed program and data related thereto, and for various other purposes. Predetermined address regions of the RAM 3 are allocated and used as registers, flags, tables, memories, etc. Particularly, in the instant embodiment, the RAM 3 is used as a data memory for temporarily storing respective paths of (or to) automatic performance files and text files (AP_PATH and TXT_PATH), an image buffer memory for temporarily storing various other information, such as image data to be used for displaying a lyrics screen.

Performance operator unit 4A is, for example, in the form of a keyboard having a plurality of keys for selecting pitches of tones, which also includes key switches in corresponding relation to the keys. The performance operator unit (e.g., keyboard) 4A can be used not only for a manual performance by the user, but also as an input means for selecting a music piece to be automatically performed in the electronic music apparatus and setting performance environments. The detection circuit 4 detects depression and release of the keys on the performance operator unit to thereby produce detection outputs. For example, a setting operator unit 5A includes: an automatic performance switch for instructing start/stop of reproduction of automatic performance data; performance data selection switches for selecting an automatic performance file (hereinafter also referred to simply as "performance file") to be automatically performed; registration selection switches for selecting a registration data file (hereinafter also referred to simply as "registration file") that is cable of collectively setting performance environments, such as a performance tempo, tone color, tone volume and effect; function switches disposed around a display 6A and operating in correspondence with contents displayed on a screen of the display 6A (see screens shown in FIGS. 3-5); a "freeze" instruction switch for instructing validity/invalidity of inhibition setting such that even an item, setting of which has been instructed by a registration file as a performance environment, is excluded from among objects of setting; etc. Needless to say, the setting operator unit 5A may include various other operators than the above-mentioned, such as a numeric keypad for inputting numerical value data to be used for selecting, setting and controlling a tone pitch, color, effect, etc., a keyboard for inputting text or character data, a mouse for operating a pointer displayed on the display 6A, etc. The detection circuit 5 detects operational states of the above-mentioned switches to output switch information, corresponding to the detected operational states, to the CPU 1 via the data and address bus 1D.

The display circuit 6 displays, on the display 6 which is in the form of a liquid crystal display (LCD) panel, CRT or the like, a list of automatic performance data (sets) capable of being automatically performed, types of performance environments to be used in an automatic performance, current settings, various screens, such as a "lyrics display screen", "text file selection screen" and "text display screen", (see FIGS. 3-5), controlling states of the CPU 1, etc. With reference to these various information displayed on the display 6A, the user can select a desired automatic performance file, registration file or text data file ((hereinafter also referred to simply as "text file"). Also, by switching as necessary between the various screens, the user can check, on the displayed screens, lyrics and various other information than lyrics. In the instant embodiment of the electronic music apparatus, lyrics data included in an automatic performance file and text data included in a text file are not transferred directly to a predetermined image memory (not shown) of the display circuit 6 for displays of the lyrics and text; instead, screen data, comprising lyrics and text images created on a page-by-page basis on the basis of the lyrics data and text data, are temporarily stored in an image buffer memory provided in the RAM 3, and the thus-buffered screen data are then transferred to the image memory of the display circuit 6 as necessary so that the lyrics and text are displayed on the display 6A. Of course, the present invention is not necessarily so limited.

The tone generator (T.G.) circuit 7, which is capable of simultaneously generating tone signals in a plurality of channels, receives, via the data and address bus ID, various performance information generated in response to user's manipulation on the performance operator unit 4A or generated on the basis of performance data of an automatic performance file, and it generates tone signals on the basis of the received performance information. Each of the tone signals thus generated by the tone generator circuit 7 is audibly reproduced or sounded by a sound system 9, including an amplifier and speaker, after being imparted with a desired effect via the effect circuit 8. The tone generator circuit 7, effect circuit 8 and sound system 9 may be constructed in any conventionally-known manner. For example, any desired tone signal synthesis method may be used in the tone generator circuit 7, such as the FM, PCM, physical model or formant synthesis method. Further, the tone generator circuit 7 may be implemented by either dedicated hardware or software processing performed by the CPU 1.

The external storage device 10 is provided for storing various files, such as automatic performance files, registration files and text files, various control-related data, such as various control programs for execution by the CPU 1, etc. Where a particular control program is not prestored in the ROM 2, the control program may be prestored in the external storage device (e.g., hard disk device) 10, so that, by reading the control program from the external storage device 10 into the RAM 3, the CPU 1 is allowed to operate in exactly the same way as in the case where the particular control program is stored in the program memory 2. This arrangement greatly facilitates version upgrade of the control program, addition of a new control program, etc. The external storage device 10 may comprise any of various removable-type media other than the hard disk (HD), such as a flexible disk (FD), compact disk (CD-ROM or CD-RAM), magneto-optical disk (MO) and digital versatile disk (DVD), and a semiconductor memory, such as a flash memory.

The MIDI interface (I/F) 11 is provided for inputting performance data of the MIDI format (i.e., MIDI data) from externally-connected other MIDI equipment 11A or the like to the electronic music apparatus, and for outputting performance data of the MIDI format (i.e., MIDI data) from the electronic music apparatus to the other MIDI equipment 11A or the like. The other MIDI equipment 11A may be of any desired type (or operating type), such as the keyboard type, string instrument type, wind instrument type, percussion instrument type or gesture type, as long as it can generate MIDI data in response to operation by a user of the equipment. The MIDI interface 11 may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface 11, the other MIDI equipment 11A connected with the electronic music apparatus of the present invention may be designed to communicate other data than MIDI event data. Of course, the performance data handled in the present invention may be of any other data format than the MIDI format, in which case the MIDI interface 11 and other MIDI equipment 11A are constructed in conformity to the data format used. The communication interface (I/F) 12 is connected to a wired or wireless communication network X, such as a LAN or Internet, via which it can be connected to a desired server computer 12A to input any of various programs and various data from the server computer 12A to the electronic music apparatus. Namely, where a particular control program or data is not stored in the ROM 2 or external storage device 10 (e.g., hard disk), the communication interface 12 is used to download the particular control program or data from the server computer 12A. It should be appreciated that the communication interface 12 may be of either or both of wired and wireless types.

Furthermore, in the electronic music apparatus of the invention, the performance operator unit 4A may be of any other type than the keyboard type, such as the stringed instrument type, wind instrument type or percussion instrument type. Moreover, the electronic music apparatus of the present invention is not limited to the type where the performance operator unit 4A, display 6, tone generator circuit 7, etc. are incorporated together within the body of the electronic music apparatus; for example, the electronic music apparatus may be constructed in such a manner that the above-mentioned components are provided separately and interconnected via communication facilities such as a MIDI interface, communication network and/or the like. Furthermore, the electronic music apparatus of the present invention may be applied to any desired type of apparatus or equipment other than the above-described electronic musical instrument type, such as a personal computer, karaoke apparatus or game apparatus.

Figure 2:
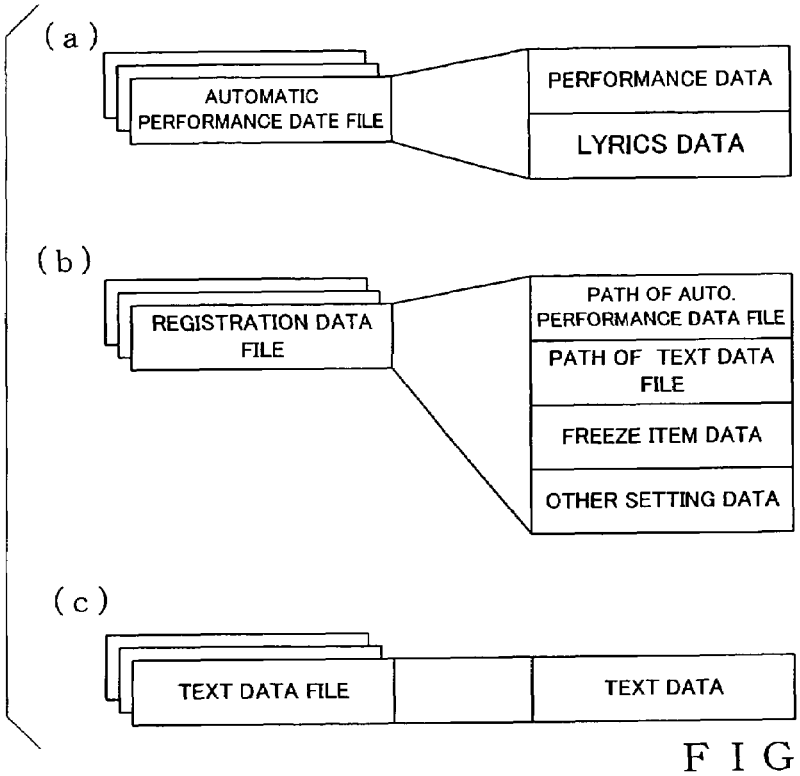
FIG. 2 is a conceptual diagram showing examples of data formats of various files, where (a), (b) and (c) show data formats of an automatic performance data file, registration data file and text data file, respectively.

The following paragraphs describe a plurality of automatic performance files, registration files and text files stored in the external storage device 10 or the like for use in the electronic music apparatus, with reference to FIG. 2. Sections (a), (b) and (c) of FIG. 2 are conceptual diagrams showing example data structures of the automatic performance files, registration files and text files, respectively. Although other data than those illustrated in the figure may be included in the automatic performance files, registration files and text files, such other data are not essential to the present invention and will not be described.

As shown in section (a) of FIG. 2, each of the automatic performance files includes performance data and lyrics data. The performance data are data indicative of contents of a music piece to be automatically performed, which, as conventionally known, comprise combinations of performance timing data and performance event data stored in performance progression order. Each of the performance event data is indicative of content of a music-piece-reproducing performance event, such as tone generation or tone deadening (i.e., silencing). More specifically, the performance event is any one of a key-on event, key-off event, tempo change event, tone color change event, etc., and an automatic performance is executed on the basis of such performance events. The performance timing data are each indicative of a time point (i.e., timing) at which the corresponding performance data is to be processed; for example, the performance timing data indicates generation timing of a performance event by an absolute time from the beginning of the music piece or measure, or by a relative time from an immediately preceding performance event. The lyrics data are each indicative of words to be displayed on the display 6A. As known in the art, the lyrics data comprise combinations of timing data each indicative of timing for displaying words of a predetermined range in accordance with a progression of a performance and lyrics event data indicative of words to be actually displayed; these combinations are stored in predetermined display order.

The performance data handled in the instant embodiment may be in any desired format, such as: the "event plus absolute time" format where the time of occurrence of each performance event (or lyrics event) is represented by an absolute time within the music piece or a measure thereof; the "event plus relative time" format where the time of occurrence of each performance event (or lyrics event) is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event (or lyrics event) is stored in one of the memory regions that corresponds to the time of occurrence of the performance event.

In the memory, time-serial performance data (or lyrics data) may be stored in successive regions, or performance data (or lyrics data) stored in dispersed regions may be managed as successive data; namely, it is only necessary that the performance data (or lyrics data) be managed as successive performance data (or lyrics data), and it does not matter whether or not the performance data (or lyrics data) are actually stored in succession in the memory. Whereas section (a) of FIG. 2 shows performance data and lyrics data as arranged independently of each other and a combination of mutually-related (or associated) performance data and lyrics data stored as a single automatic performance file, the present invention is not so limited; for example, the lyrics event data may be mixedly included at appropriate locations in the performance data.

Each of the registration file comprises data pertaining to various parameters that have to be set in advance for shared use by all of performance parts included in an object of a performance (i.e., music piece to be performed), such as data that pertain to, for example, setting of a performance tempo, time (or meter), tone color and effect of each of the performance parts, etc. By selecting a desired one of the registration files, the user can collectively set performance environments in the electronic music apparatus with ease. As illustrated in section (b) of FIG. 2, each of the registration files includes paths of an automatic performance file and text file, freeze item data, and other setting data. The path of an automatic performance file is automatic performance data selection information that points to a hierarchical storage location in the external storage device 10 or the like storing the automatic performance file to which the performance environments in question are to be applied; the path is indicative of, for example, names of a disk, directory and automatic performance file. Needless to say, where no automatic performance file, to which the performance environments in question are to be applied, has been set in advance, the registration file need not include any path of an automatic performance file. Where any path of an automatic performance file, to which the performance environments in question are to be applied, is included, the automatic performance data and text file are associated with each other. The path of the text file is text file selection information that points to a hierarchical storage location in the external storage device 10 or the like storing the automatic performance file to which the performance environments in question are to be applied; the path includes, for example, names of a disk, directory, text file, etc.

The freeze item data is data indicative of an item that can be excluded from among objects of setting (to permit no setting therefor) although the registration file instructs setting of the item as a performance environment. For the item designated as the freeze item data, the user can use the freeze instruction switch to set, as necessary, validity/invalidity of inhibition setting as to whether a performance environment should be reflected or not. For example, where a "text file" is designated as the freeze item data and a "freeze" has been instructed by the user operating the freeze instruction switch, readout of the text file based on the path and a new screen display based on the text file are not carried out, so that the last (immediately preceding) screen display is continued as before. Further, where a "text file" is designated as the freeze item data but no freeze has been instructed by the user operating the freeze instruction switch, readout of the text file based on the path and a new screen display based on the text file are carried out. The above-mentioned other setting data are performance environment setting information for setting performance environments, such as a tone color, volume, time (or meter) and tempo, to be used in a manual performance and/or automatic performance.

Each of the text files comprises data that can be created by the user using a personal computer etc. As illustrated in section (c) of FIG. 2, the text file comprises text data including lyrics and various other information than lyrics. In the context of the present invention, the terms "text file" are used to refer to any one of a plain text file comprising text data represented only in pure letters, markup language file including various tags (e.g., HTML, XML or the like), and rich text file or word processing file including format information etc. In short, each text file may be of any format as long as it includes text data and it can be created with ease via a personal computer etc. Further, the text file may also include other data than the text data, such as image data. The electronic music apparatus of the invention is equipped with a program that can read and visually display such text files of various formats.

Some registration file may include a plurality of pieces of text file selection information (in this case, paths of text files) so that the text files can be selected sequentially or in any desired manner through operation of predetermined operators of the electronic music apparatus. In another alternative, after the end or beginning of one text file has been reached through page switching or turning operation, the next text file may be selected by further page switching operation.

It is desirable that one or more registration files be assigned to one or more operators (registration selection switches) of the electronic music apparatus so that the user can readily select any desired one of the registration files by operating a corresponding one of the operators (registration selection switches). In another alternative, a sequence of a plurality of registration files to be sequentially selected may be preset so that the registration files are sequentially read out automatically or in response to operation, by the human operator, of predetermined operators in accordance with a progression of a performance so that performance environments can be set in accordance with the performance progression.

Figure 3:
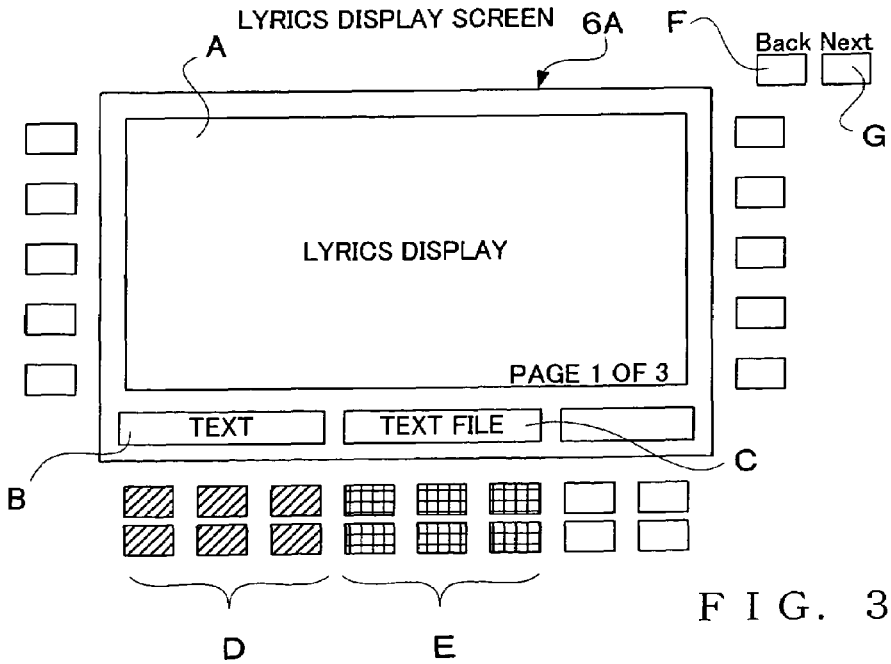
FIG. 3 is a conceptual diagram showing an example of a lyrics display screen.

Now, a description will be made about various screens displayed on the display 6A. FIG. 3 is a conceptual diagram showing an example of the "lyrics display screen" for displaying lyrics on the basis of lyrics data. Specifically, this example of the "lyrics display screen" displays words of a predetermined range corresponding to a page, in accordance with lyrics screen data including a plurality of lyrics images of the music piece in question which were divided into a plurality of pages in accordance with a size of the display 6A determined by a size of the display screen (or display window); lyrics of a predetermined range are displayed per page. On the display area A, a "Text" indication B and "Text File" indication C are given in addition to and immediately beneath the lyrics display of one page. The "Text" indication B and "Text File" indication C show what function has been allocated to each of a number of function switches disposed around the display 6A. Once any one of the function switches D, corresponding in position to the "Text" indication B, is depressed, the displayed screen is switched from the "lyrics display screen" to a "text display screen" that will be later described with reference to FIG. 5. Namely, to each of the function switches D is allocated a function for switching between the "lyrics display screen" and the "text display screen". Further, once any one of the function switches E, corresponding in position to the "text file" indication C, is depressed, the displayed screen is switched from the "lyrics display screen" to a "text file selection screen" that will be later described with reference to FIG. 4. Namely, to each of the function switches E is allocated a function for switching between the "lyrics display screen" and the "text file selection screen". "Back" and "Next" switches F and G shown on an upper right area of FIG. 3 are provided for turning to pages immediately preceding and succeeding the currently-displayed page; however, no page switching is made during an automatic performance.

Figure 4:
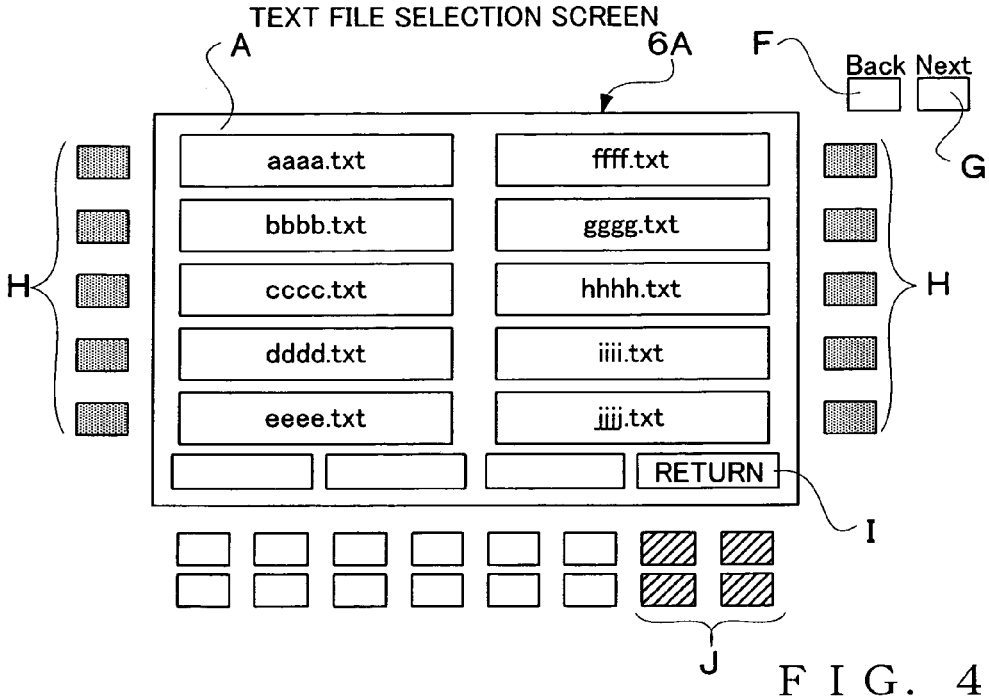
FIG. 4 is a conceptual diagram showing an example of a text file selection screen.

FIG. 4 is a conceptual diagram showing an example of the "text file selection screen" that displays a list of user-created text files to permit selection of a desired one of the text files. More specifically, the "text file selection screen" displays, on the display area A, a list of file names (aaaa.txt, bbbb.txt, etc.) of one or more text files created in advance by the user. Once any one of function switches H disposed to the left and right of the display 6A is depressed, the text file of the file name corresponding to the depressed function switch H is selected, and the displayed screen is switched from the "text file selection screen" back to the last screen ("lyrics display screen" or "text display screen") that was being displayed immediately before the switching. If, in this case, the displayed screen has been switched back to the "text display screen", contents of the selected text file are displayed. Namely, to the each of the function switches H is allocated a function to operate as a switch for selecting a desired text file. "Return" indication I is given on the display area A in addition to the "file name" display. When any one of function switches J, corresponding in position to the "Return" indication I, has been depressed, the displayed screen is switched from the "text file selection screen" to the last screen ("lyrics display screen" or "text display screen"), similarly to the above-described. Namely, to each of the switches J is allocated a function to operate as a switch for returning the displayed display to the last screen with no text file selected. Where there are stored text files greater in number than the number of text files (ten text files in the illustrated example) capable of being displayed at a time on the display area A, a "Back" switch F and "Next" switch G are operable to cause the other text files than the currently-displayed text files to be displayed on another page of the text file selection screen.

Figure 5:
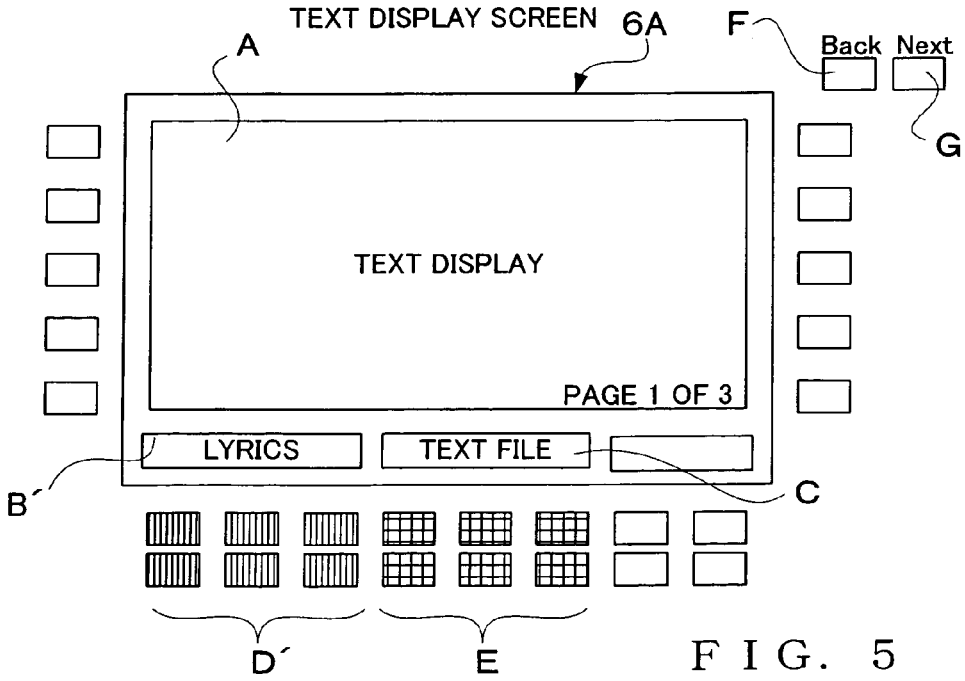
FIG. 5 is a conceptual diagram showing an example of a text display screen.

FIG. 5 is a conceptual diagram showing an example of the "text display screen" displayed on the basis of a text file. The "text display screen" displays, in text form on the display area A, various information of predetermined ranges corresponding to pages, in accordance with text screen data (created from a text file to be displayed) composed of a plurality of text divided on the page-by-page basis. On the display area A, there are displayed at a time, one page of the text, a "Lyrics" indication B' and "Text File" indication C immediately below the text display. Once any one of function switches D', corresponding in position to the "Text" indication B', is depressed on the "text display screen", the displayed screen is switched from the "text display screen" to the "lyrics display screen". Further, once any one of function switches E, corresponding in position to the "Text File" indication C, is depressed, the displayed screen is switched from the "text display screen" to the "text file selection screen". Namely, to each of the function switches D' and E is allocated a function to operate as a switch for switching between the "lyrics display screen" and the "text display screen". "Back" and "Next" switches F and G on an upper right area of FIG. 5 are provided for returning to pages immediately preceding and succeeding the currently-displayed page. On the "text display screen", page switching is carried out in response to user's operation irrespective of whether an automatic performance is in progress or not, unlike on the "lyrics display screen".

Text files to be displayed on the above-mentioned "text file selection screen", etc. may be supplied to the electronic music apparatus in any of various manners, e.g. via an external storage media, via a communication interface, or by the user directly creating the text files on the electronic music apparatus (e.g., creating the text files by operating the setting operator unit 5A of the electronic music apparatus while viewing displayed contents on the display 6A). Particularly, in the case where the text files are supplied via the communication interface, the electronic music apparatus may be caused to function as a storage device (e.g., USB storage device) as viewed from a personal computer, and the personal computer may directly create and edit text files within the electronic music apparatus via the communication interface (USB).

Further, text files may be prestored in a device external to the electronic music apparatus, and paths to the text files in the external device may be described in registration data. If the text files are Web page data (e.g., in the HTML or XML format) stored in a Web site on a network and if the URLs of the Web page data are described, as paths to the text files, in registration data, then Web pages associated with the registration data can be displayed on the electronic music apparatus in response to selection of the registration data. More specifically, access is made, via the communication network 12, to the URLs described in the registration data, in response to selection of the registration data, so as to acquire (receive) the corresponding Web page data via the communication network 12, and the thus-acquired Web page data are displayed on the display 6A of the electronic music apparatus. Note that the text files in the Web site may be ones created and uploaded to the Web site by the user of the electronic music apparatus, or ones created and uploaded to the Web site by the supplier (maker, distributor or the like) of the electronic music apparatus. Note that the above-mentioned external device may be other than a web site on a network, such as a file server constructed on a LAN or a personal computer or other electronic music apparatus connected to the electronic music apparatus of the invention via a communication interface, such as a USB.

Regarding the text file display on the above-mentioned "text display screen", arrangements may be made such that the user can select, through operation of the setting operator unit 5A, a desired type and size of a font to be displayed, displayed color, displayed position (e.g., left-justified, center or right-justified), linefeed (whether or not to begin a new line at an end of the displayed screen). These setting information may be described in advance in a registration file so that the above-mentioned items can be automatically set by selection of the registration file. Further, there may be provided an application program (hereinafter called "display simulating application"), to be executed by a personal computer, having a display screen simulative of the display specifications of the display 6A of the electronic music apparatus, in order to readily ascertain how the contents of a text file are to be displayed as the "text display screen" on the display 6A of the electronic music apparatus. If, in such a case, the user is allowed to use the display simulating application to create and edit a text file, or read a text file created and edited via a separately-provided text editor or the like so that a display style of the text file can be ascertained, so that it is possible to eliminate the need to supply the text file to the electronic music apparatus only for the ascertaining purposes, which is very convenient.

Whereas the preferred embodiment has been described above in relation to the case where only one of the lyrics display and text display is made at a time, both the lyrics display and the text display may be made at a time in parallel to each other. In such a case, either one of the lyrics display and text display may be made a main display with the other display made in a smaller font to highlight the main display, in accordance with a screen switching instruction given via user's operation of a predetermined switch.

Figure 6A:
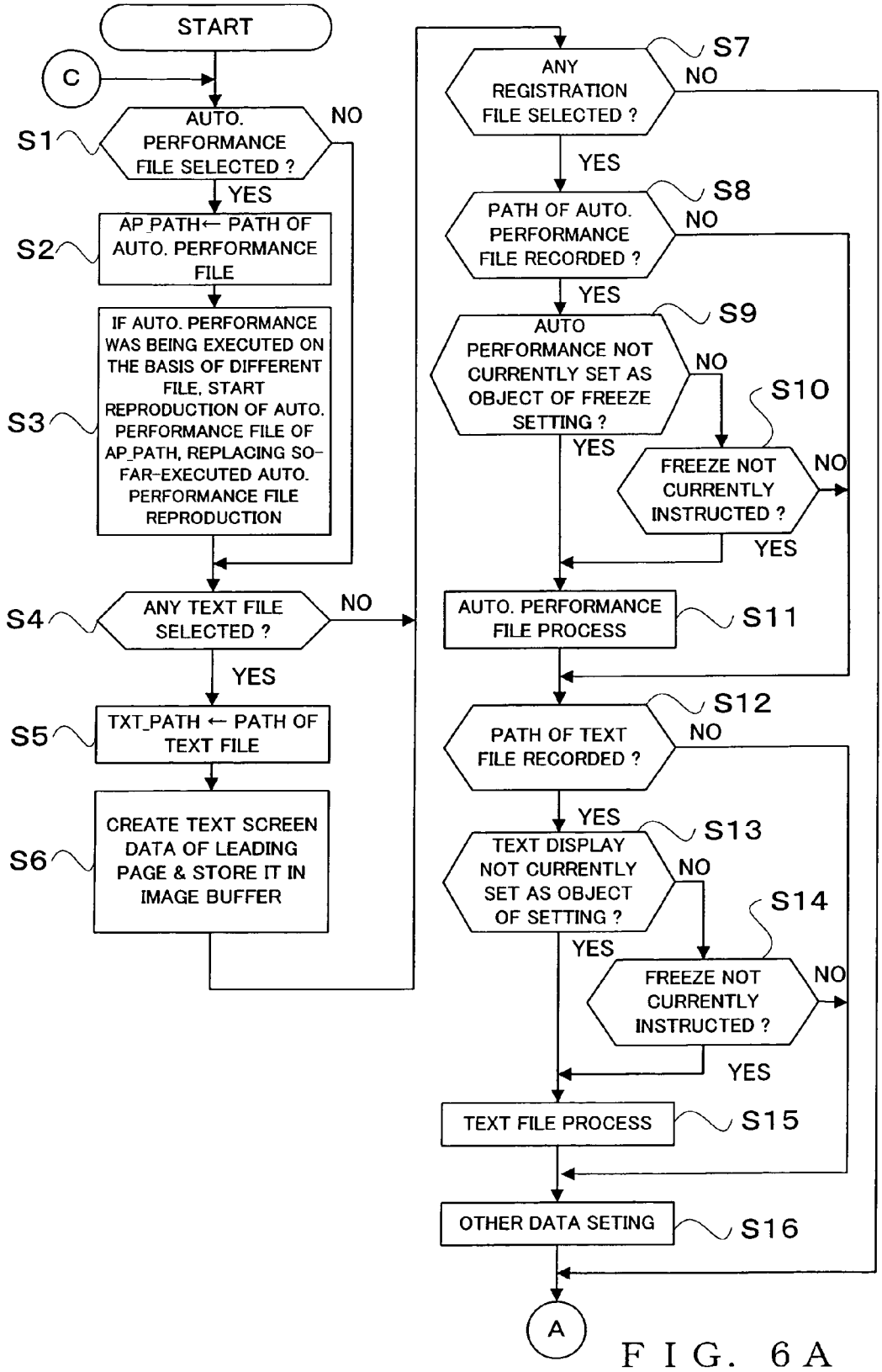
FIGS. 6A, 6B and 6C are flow charts showing an embodiment of main processing performed by a CPU in the electronic music apparatus.
Figure 6B:
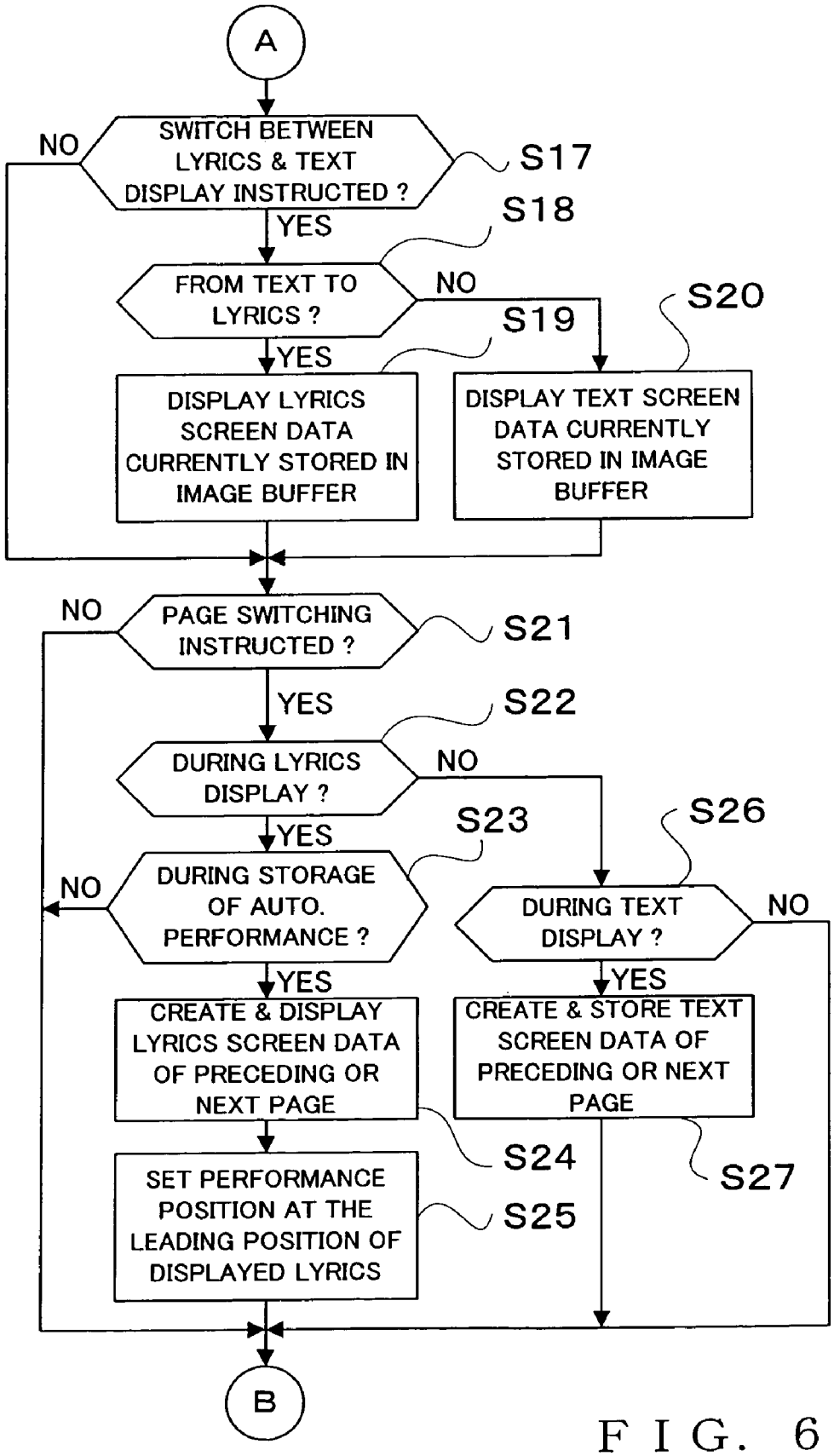
Figure 6C:
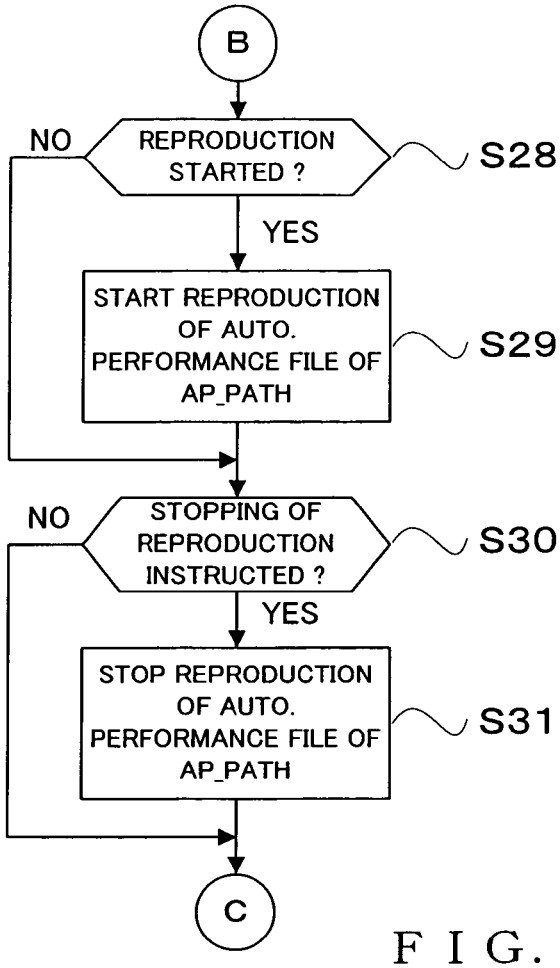

Next, with reference to FIGS. 6A-6C, a description will be given about "main processing" for performing various operations in response to user's operation of predetermined switches etc. FIGS. 6A, 6B and 6C are flow charts showing an embodiment of the "main processing" performed by the CPU 1 shown in FIG. 1. For convenience of illustration, the "main processing" is shown as divided into three parts: a front part shown in FIG. 6A; a middle part shown in FIG. 6B; and a rear part shown in FIG. 6C.

First, at step S1 of FIG. 6A, a determination is made as to whether any automatic performance file has been selected in response to operation, by the user, of any of the performance data selection switches. If any automatic performance file has been selected (YES determination at step S1), the path of the selected automatic performance file is stored into the data memory (AP_PATH), at step S2. If, at the time of operation of the performance data selection switch, an automatic performance was being executed on the basis of a file different from the selected automatic performance file, reproduction of the automatic performance file newly selected on the basis of the path stored in the data memory (AP_PATH) is started, replacing the file reproduction that was being executed immediately before the operation of the performance data selection switch, at step S3. At step S4, it is determined whether or not any text file has been selected in response to user's operation of any one of the function switches H during display of the "text file selection screen". If any text file has been selected (YES determination at step S4), the path of the selected text file is stored into the data memory (TXT_PATH), at step S5. Then, the text screen data of the leading or first page are created in the image buffer, at step S6. If the "text file selection screen" currently displayed is a screen having replaced (i.e., having been switched from) the "text display screen", the thus-created text screen data are transferred to the image memory, and the displayed screen on the display 6A is brought from the "text file selection screen" back to the leading page of the "text display screen".

At step S7, a determination is made as to whether any registration file has been selected in response to user's operation of any of the registration selection switches. If no registration file has been selected (NO determination at step S7), the CPU 1 jumps to step S17 of FIG. 6B to be later described, without performing various performance environment setting based on a registration file as set forth below. If, on the other hand, any registration file has been selected (YES determination at step S7), a further determination is made, at step S8, as to whether the registration file has a path of any automatic performance file recorded therein. If a path of any automatic performance file is recorded in the automatic performance file (YES determination at step S8), it is further determined, at step S9, whether the automatic performance is not currently set as an object of freeze setting. If the automatic performance is currently set as an object of freeze setting (NO determination at step S9), a further determination is made, at step S10, as to whether the freeze is not being currently instructed by the user operating the freeze instructing switch. If the freeze is not being currently instructed by the user (YES determination at step S10), an automatic performance file process is performed in accordance with the recorded path of the automatic performance file, at step S11. The "automatic performance file process" is a process corresponding to steps S2 and S3 above. Namely, the path of the automatic performance file recorded in the registration file is stored into the data memory (AP_PATH), and an automatic performance is initiated on the basis of the automatic performance file.

At step S12, a determination is made as to whether the registration file has a path of any text file recorded therein. If a path of any text file is recorded in the registration file (YES determination at step S12), it is further determined, at step S13, whether the text display is not currently set as an object of freeze setting. If the text display is currently set as an object of freeze setting (NO determination at step S13), a further determination is made, at step S14, as to whether the freeze is not being currently instructed by the user operating the freeze instructing switch. If the freeze is not being currently instructed (YES determination at step S14), a text file process is performed, at step S15. The "text file process" is a process corresponding to steps S5 and 6 above. Namely, the path of the selected text file recorded in the registration file is stored into the data memory (TXT_PATH) at step S5, and then, the text screen data of the leading page are created on the basis of the text file in the image buffer, at step S6. Further, if the "text file selection screen" currently displayed is a screen having replaced (i.e., having been switched from) the "text display screen", the thus-created text screen data are transferred to the image memory, and the displayed screen on the display 6A is brought from the "text file selection screen" back to the leading page of the "text display screen". At step S16, setting of other data is performed. Namely, on the basis of the "other setting data" of the registration file, corresponding environments are set.

Then, at step S17 of FIG. 6B, a determination is made as to whether a switch between the lyrics and text displays has been instructed through user's operation of any one of the function switches D, D' during display of the "lyrics display screen" or "text display screen". If such a switch between the lyrics and text displays has been instructed (YES determination at step S17), a further determination is made, at step S18, as to whether the instructed switch is from the text display to the lyrics display. With a YES determination at step S18, lyrics screen data currently stored in the image buffer are transferred to the image memory, so that a page of the lyrics, corresponding to a currently-performed position, is displayed at step S19. If, on the other hand, the instructed switch is from the lyrics display to the text display (NO determination at step S18), text screen data currently stored in the image buffer are transferred to the image memory, so that the instructed text page is displayed at step S20.

At next step S21, a determination is made as to whether page switching has been instructed through user's operation of the "Back" or "Next" switch F or G. If page switching has been instructed (YES determination at step S21), it is further determined, at step S22, whether the page switching has been instructed during display of lyrics. If the page switching has been instructed during display of lyrics (YES determination at step S22), a further determination is made, at step S23, as to whether the page switching has been instructed while no automatic performance was being executed or during stoppage of an automatic performance. With a YES determination at step S23, lyrics screen data of the preceding or next page are created in response to the page switching instruction, and the thus-created lyrics screen data are transferred from the image buffer to the image memory so as to display the preceding or next page (step S24). Then, a current performance position of the automatic performance is set at the leading position of the displayed lyrics, at step S25. If the page switching instruction has not been given while no automatic performance was being executed or during stoppage of an automatic performance (NO determination at step S23), the operations of steps S24 and S25 are not carried out. Namely, because, during execution of an automatic performance, corresponding lyrics are displayed in accordance with a progression of the automatic performance, the page switching instruction by the user is ignored so as to prevent a current automatically-performed position of the music piece and currently-displayed words from disagreeing with each other. If the page switching instruction has not been given during display of the lyrics as determined step S22 (NO determination at step S22), a determination is made, at step S26, as to whether the page switching instruction has been given during display of text ("text display screen"). With a YES determination at step S26, text screen data of the preceding or next page are created in response to the page switching instruction, and the thus-created text screen data are transferred from the image buffer to the image memory so as to display the preceding or next page of the text (step S27).

As illustrated in FIG. 6C, a determination is made, at step S28, as to whether starting of reproduction has been instructed by the user operating the automatic performance switch. If starting of reproduction has been instructed (YES determination at step S28), reproduction of an automatic performance file is started on the basis of the path stored in the data memory (AP_PATH), at step S29; this automatic performance process will be later described with reference to FIG. 7. At next step S30, a further determination is made as to whether stopping of the reproduction has been instructed by the user operating the automatic performance switch. If stopping of the reproduction has been instructed (YES determination at step S30), the reproduction of the automatic performance file based on the path stored in the data memory (AP_PATH) is brought to a stop, at step S31. Upon completion of all of the operations in the main processing shown in FIGS. 6A-6C, the CPU 1 reverts to step S1 of FIG. 6A to repeat the operations of steps S1-S31.

Figure 7:
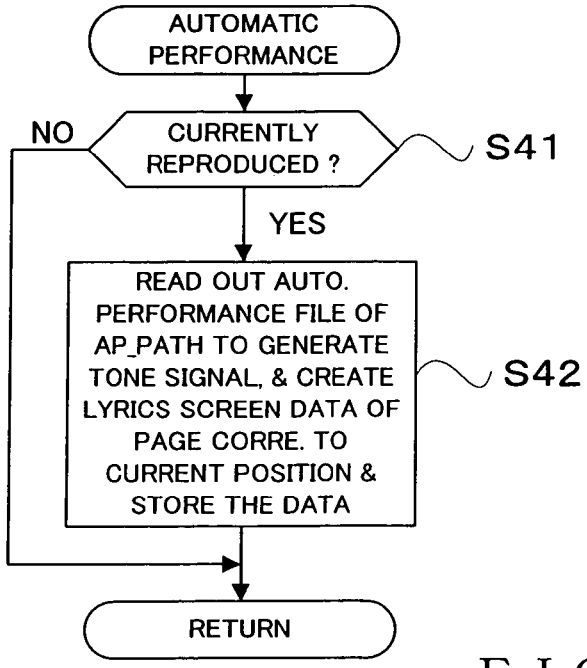
FIG. 7 is a flow chart showing an embodiment of an automatic performance process.

Now, with reference to FIG. 7, a description will be given about the "automatic performance process" which is carried out, in parallel to the "main processing" of FIG. 6, to execute an automatic performance by reproducing an automatic performance file. FIG. 7 is a flow chart showing an embodiment of the "automatic performance process". First, at step S41, a determination is made as to whether an automatic performance is currently being reproduced. With a YES determination at step S41, an automatic performance file is read out, in accordance with the path stored in the data memory (AP_PATH), to generate tone signals, lyrics screen data of a page, including words corresponding to a currently-reproduced position, are created on the basis of lyrics data, and the thus-created lyrics screen data are stored into the image buffer (step S42). Thus, by only transferring the lyrics screen data of the page, including words corresponding to the current reproduced position, from the image buffer (e.g., step S19), it is possible to display words corresponding to the current reproduced position of the automatic performance data.

Figure 8:
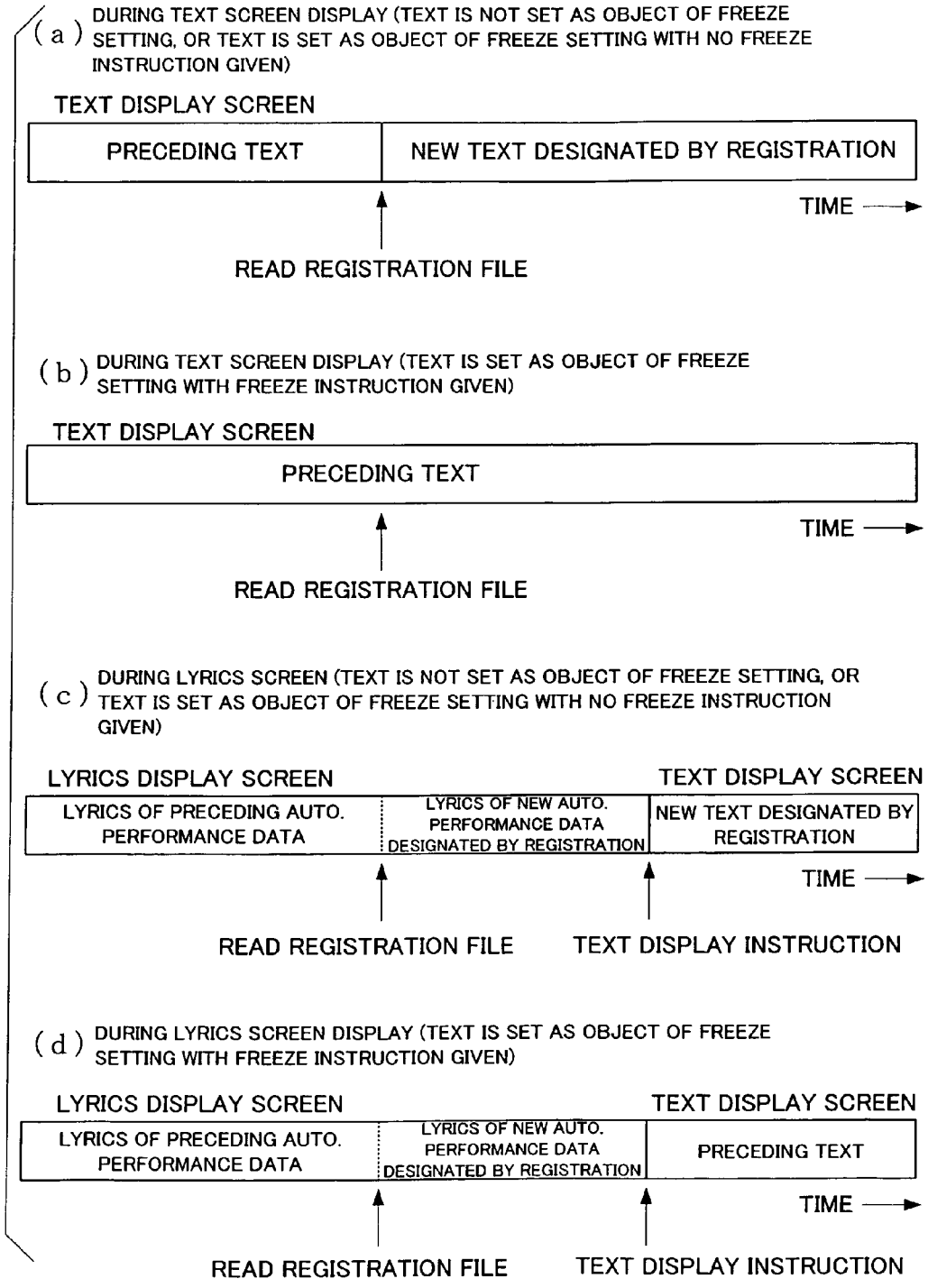
FIG. 8 is a conceptual diagram showing specific examples of screen switching processes responsive to user's operation of registration selection switches.
Figure 9:
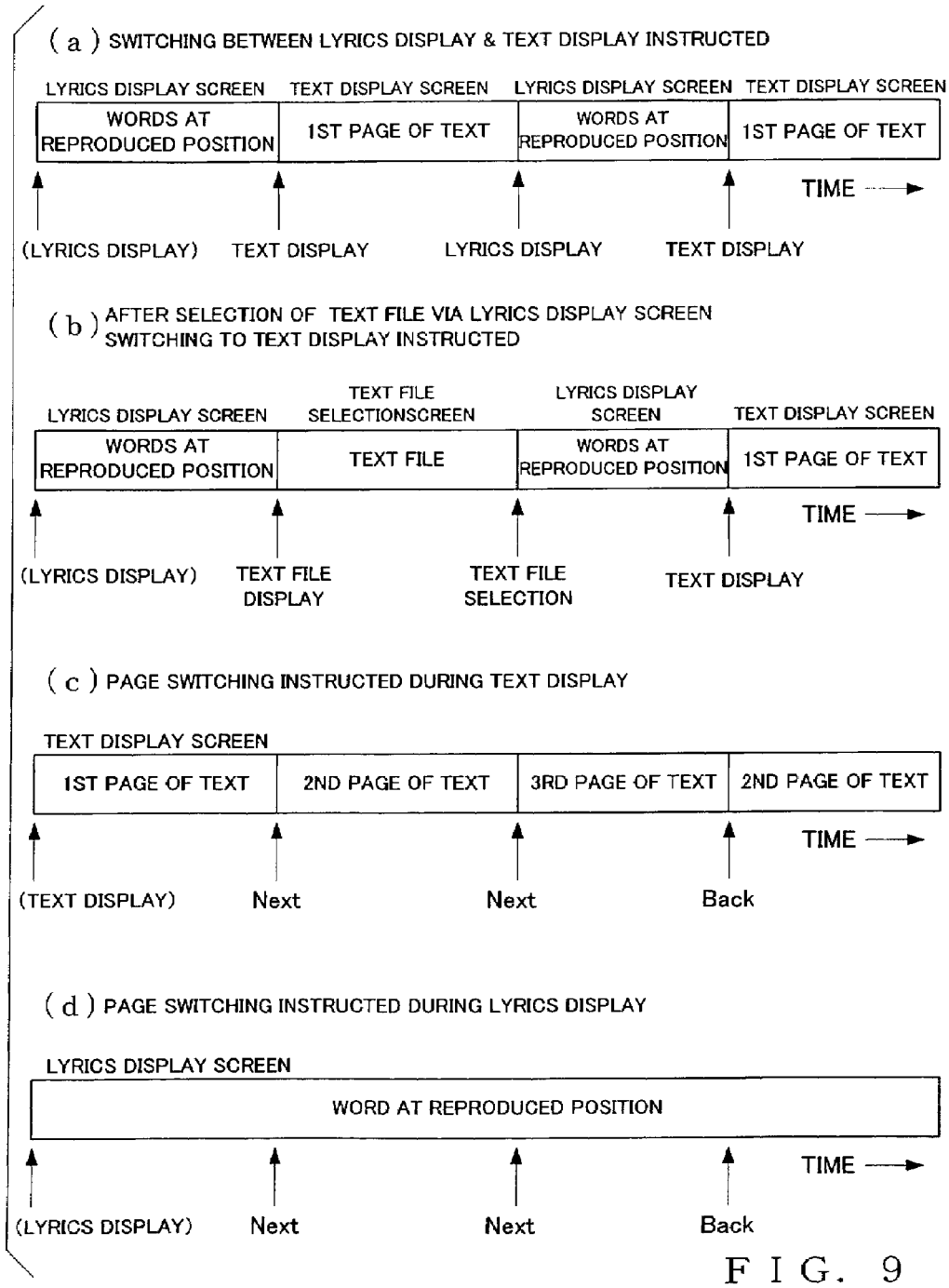
FIG. 9 is a conceptual diagram showing specific examples of screen switching processes responsive to user's switch operation during an automatic performance.

The following paragraphs describe specific examples of screen switching processes responsive to user's operation of predetermined switches, with reference to FIGS. 8 and 9. FIG. 8 is a conceptual diagram showing specific examples of the screen switching processes responsive to user's operation of the registration selection switches. FIG. 9 is a conceptual diagram showing specific examples of the screen switching processes responsive to user's operation, during an automatic performance, of any one of the function switches, "Back" switch and "Next" switch.

When a registration file has been read out, during display of the "text display screen", in response to user's operation of the registration selection switch, as illustrated in section (a) of FIG. 8, display switching is made from a "preceding text", which was being displayed immediately before the operation of the switch, to a "new text" designated by the registration data. However, if a "text file" is designated, as an object of the freeze setting, in the read-out registration file and if the freeze has been instructed by operation of the freeze instructing switch, as illustrated in section (b) of FIG. 8, the display of the "preceding text" is continued as before, with no switchover made from the "preceding text", which was being displayed immediately before the operation of the switch, to the "new text" designated by the registration data. Further, when a registration file has been read out, during display of the "lyrics display screen", in response to user's operation of any of the registration selection switches, as illustrated in sections (c) and (d) of FIG. 8, display switching is made from "lyrics of preceding automatic performance data", which were being displayed immediately before the operation of the switch, to "lyrics of new automatic performance data" designated by the registration data. Further, once a text display instruction has been given via the "lyrics display screen", display switching is made from the "lyrics display screen" to the "text display screen" to display "new text" designated by the registration data (section (c) of FIG. 8). However, if a "text file" is designated, as an object of the freeze setting, in the selected registration file and if the freeze has been instructed by operation of the freeze instructing switch, as illustrated in section (d) of FIG. 8, the display of the "preceding text" designated by the last registration file is continued as before, without the "new text" designated by the registration data being displayed.

If the "lyrics display screen" is being displayed during an automatic performance, the display is updated, in accordance with a progression of the automatic performance, with a page including "words at a current reproduced position", as illustrated in section (a) of FIG. 9. Further, once a text display instruction has been given via the "lyrics display screen", display switching is made from the "lyrics display screen" to the "text display screen" to display a designated page ("first page of the text" if no particular page is designated). Once a lyrics display instruction has been given via the "text display screen", display switching is made from the "text display screen" to the "lyrics display screen" to display a page including "words at a current reproduced position" in accordance with a progression of the automatic performance. Then, when a text display instruction has been given via the "lyrics display screen", the page of the text which was being displayed at the time of switching to the "lyrics display screen" (first page in this case) is displayed. Further, once a text file selection instruction has been given, during an automatic performance, via the "lyrics display screen" displaying the page including the "words at the current reproduced position", as illustrated in section (b) of FIG. 9, switching is made from the "lyrics display screen" to the "text file selection screen" to display a page including "words at a current reproduced position" in accordance with a progression of the automatic performance. Then, when a text display instruction has been given via the "lyrics display screen", the first page of text is displayed on the basis of a newly-selected text file. Because the instant embodiment allows a text file to be selected while lyrics data are being displayed, the user can readily select a text file even during display of the lyrics, without having to perform operation of, for example, temporarily stopping the lyrics display and then selecting the text file.

When the "Next" or "Back" switch (see FIG. 5) has been operated during display of the "text display screen", as illustrated in section (c) of FIG. 9, switching is made from one display to another in response to the operation of the switch. For example, when the "Next" switch has been operated one or more times during display of the "first page of text", one or more pages of text are sequentially displayed in order of ascending page numbers (like "second page of text"→"second page of text") in accordance with the number of times the "Next" switch has been operated. On the other hand, when the "Back" switch has been operated one or more times during display of the "third page of text" as illustrated, one or more pages of text are sequentially displayed in order of descending page numbers (like "second page of text"→"first page of text") in accordance with the number of times the "Back" switch has been operated. When the "Next" or "Back" switch (see FIG. 5) has been operated during display of the "lyrics display screen" for an automatic performance, as illustrated in section (d) of FIG. 9, the switch operation is ignored, so that no switching is made to the page to be displayed. Because, during an automatic performance, each page including relevant lyrics is displayed in accordance with a progression of the automatic performance as explained above, a current automatically-performed position of the music piece and currently-displayed words can be prevented from disagreeing with each other, by ignoring the page switching operation. Thus, when no automatic performance is being executed, display switching is made from one page to another page in response to operation of the "Next" or "Back" switch. Namely, page switching of the text display screen is validated but page switching of the lyrics display screen is invalidated, in response to operation of the "Next" or "Back" switch during an automatic performance. Thus, where the text has a plurality of pages, the instant embodiment not only allows the text to be displayed while switching between the pages, but also can prevent erroneous switching between the pages during display of the lyrics (i.e., can prevent jumping of the automatically-performed position).

As described above, the present invention is characterized by including text file selection information ("path of a text data file" in the above-described embodiments) in each registration file so that selecting the registration file can also select the text file. In this way, the user is allowed to readily select the text file (contents of which are not necessarily limited to lyrics data) with a desired file name attached thereto, by only selecting the registration file. Particularly, because the text file selection information is included in the registration file, the present invention permits association between performance (manual or automatic performance)-related data defined in the registration file and a text file; thus, the user can readily select a text file that fits contents of a performance.

Further, when a registration file has been selected, contents of a selected text file are immediately displayed if the current display screen is the text display screen; however, if the current display screen is other than the text display screen (i.e., the lyrics display screen in the above-described embodiments), the current display screen is left unchanged, and the contents of the selected text file are displayed later when the display screen is switched to the text display screen. In this way, text data can be displayed at appropriate timing, i.e. immediately if the current display screen is the text display screen, but later when the display screen is switched to the text display screen if the current display screen is other than the text display screen. Furthermore, when the inhibition setting (i.e., freeze setting in the above-described embodiments) is in operation, the present invention inhibits selection of a registration file; thus, even with a same registration file including same text file selection information, the present invention can perform control to select or to not select the text file, as desired.

What is claimed is:

1. An electronic music apparatus having a performance operator unit and a performance environment setting operator unit, said electronic music apparatus generating a tone according to an operation of the performance operator unit and based on a performance environment set by the performance environment setting operator unit, said electronic music apparatus comprising:

a first storage section that stores text files each including at least text data;

a second storage section that stores registration data including predetermined performance environment setting information representative of a performance environment to be automatically set in association with the performance environment setting operator unit and text file selection information specifying a text file associated with the performance environment represented by the performance environment setting information;

a selection section that selects registration data from said second storage section;

a text selection section that, in accordance with the text file selection information of the registration data selected via said selection section, selects the text file associated with the performance environment from among the text files stored in said first storage section; and a display section that, on the basis of the text file selected via said text selection section, displays the text data included in the selected text file, wherein said electronic music apparatus generates a tone based on the performance environment represented by the performance environment setting information.

2. An electronic music apparatus as claimed in claim 1 wherein, when said display section is already displaying text data at the time of selection, by said selection section, of the registration data, said display section immediately displays the text data of the text file selected by said text selection section, but, when said display section is not yet displaying text data at the time of the selection, by said selection section, of the registration data, said display section, instead of immediately displaying the text data of the selected text file, displays the text data of the selected text file later when a state for displaying the text data arrives.

3. An electronic music apparatus as claimed in claim 1 which further comprises a setting section that performs predetermined inhibition setting, and wherein, when the inhibition setting is in operation, said text selection section does not select the text file associated with the performance environment.

4. An electronic music apparatus as claimed in claim 1, wherein said registration data stored in said second storage section further includes predetermined performance data specifying information and second text file selection information specifying a second text file associated with automatic performance data specified on the basis of the performance data specifying; and wherein said text selection section, in accordance with the second text file selection information of the registration data selected via said selection section, further selects the second text file associated with the automatic performance data from among the text files stored in said first storage section; and wherein said display section displays text data included in the selected second text file.

5. An electronic music apparatus as claimed in claim 4 wherein, when said display section is already displaying text data at the time of selection, by said selection section, of the registration data, said display section immediately displays the text data of the selected second text file, but, when said display section is not yet displaying text data at the time of the selection, by said selection section, of the registration data, said display section, instead of immediately displaying the text data of the selected second text file, displays the text data of the selected second text file later when a state for displaying the text data arrives.

6. An electronic music apparatus as claimed in claim 4 which further comprises a setting section that performs predetermined inhibition setting, and wherein, when the inhibition setting is in operation, said text selection section does not select the second text file associated with the automatic performance data.

7. An electronic music apparatus capable of communicating with an external device that stores text files each including at least text data, said electronic music apparatus having a performance operator unit and a performance environment setting operator unit, said electronic music apparatus generating a tone according to an operation of the performance operator unit and based on a performance environment set by the performance environment setting operator unit, said electronic music apparatus comprising:

a storage section that stores registration data including predetermined performance environment setting information representative of a performance environment to be automatically set in association with the performance environment setting operator unit and text file selection information specifying a particular one of the text files, stored in the external device, which is associated with a performance environment represented by the performance environment setting information;

a selection section that selects the registration data from said storage section;

a communication section that communicates with the external device;

a text acquisition section that, in accordance with the text file selection information of the registration data selected via said selection section, acquires any one of the text files stored in the external device; and a display section that, on the basis of the text file acquired by said text acquisition section, displays the text data included in the acquired text file, wherein said electronic music apparatus generates a tone based on the performance environment represented by the performance environment setting information.

8. A method for displaying music-related data in an electronic music apparatus having a performance operator unit, a performance environment setting operator unit, a first storage section and a second storage section, said electronic music apparatus generating a tone according to an operation of the performance operator unit and based on a performance environment set by the performance environment setting operator unit, said first storage section storing text files each including at least text data, said second storage section storing registration data including predetermined performance environment setting information representative of a performance environment to be automatically set in association with the performance environment setting operator unit and text file selection information specifying a text file associated with the performance environment represented by the performance environment setting information, said method comprising:

a step of selecting registration data from said second storage section;

a text selection step of, in accordance with the text file selection information of the registration data selected via said step of selecting, selecting the text file associated with the performance environment from among the text files stored in said first storage section; and a display step of, on the basis of the text file selected via said text selection step, displaying the text data included in the selected text file, wherein said electronic music apparatus generates a tone based on the performance environment represented by the performance environment setting information.

9. A method as claimed in claim 8, wherein said registration data stored in said second storage section further includes predetermined performance data specifying information and second text file selection information specifying a second text file associated with automatic performance data specified on the basis of the performance data specifying information, and wherein said text selection step, in accordance with the text file selection information of the second registration data selected via said step of selecting, further selects the second text file associated with the automatic performance data from among the text files stored in said first storage section; and wherein said display step displays text data included in the selected second text file.

10. A method for displaying music-related data in an electronic music apparatus capable of communicating with an external device that stores text files each including at least text data, said electronic music apparatus having a performance operator unit, a performance environment setting operator unit and a storage section, said electronic music apparatus generating a tone according to an operation of the performance operator unit and based on a performance environment set by the performance environment setting operator unit, said storage section storing registration data including predetermined performance environment setting information representative of a performance environment to be automatically set in association with the performance environment setting operator unit and text file selection information specifying a particular one of the text files, stored in the external device, which is associated with a performance environment represented by the performance environment setting information, said method comprising:

a step of selecting the registration data from said storage section;

a text acquisition step of in accordance with the text file selection information of the registration data selected via said step of selecting, acquiring any one of the text files stored in the external device; and a step of, on the basis of the text file acquired by said text acquisition step, displaying the text data included in the acquired text file, wherein said electronic music apparatus generates a tone based on the performance environment represented by the performance environment setting information.

11. A computer-readable medium containing a program for causing a computer to perform a procedure for displaying music-related data in an electronic music apparatus having a performance operator unit, a performance environment setting operator unit, a first storage section and a second storage section, said electronic music apparatus generating a tone according to an operation of the performance operator unit and based on a performance environment set by the performance environment setting operator unit, said first storage section storing text files each including at least text data, said second storage section storing registration data including predetermined performance environment setting information representative of a performance environment to be automatically set in association with the performance environment setting operator unit and text file selection information specifying a text file associated with the performance environment represented by performance environment setting information, said procedure comprising:

a step of selecting registration data from said second storage section;

a text selection step of, in accordance with the text file selection information of the registration data selected via said step of selecting, selecting the text file associated with the performance environment from among the text files stored in said first storage section; and a step of, on the basis of the text file selected via said text selection step, displaying the text data included in the selected text file, wherein said electronic music apparatus generates a tone based on the performance environment represented by the performance environment setting information.

12. A computer-readable medium as claimed in claim 11, wherein said registration data stored in said second storage section further includes predetermined performance data specifying information and second text file selection information specifying a second text file associated with automatic performance data specified on the basis of the performance data specifying information, and wherein said text selection step, in accordance with the text file selection information of the second registration data selected via said step of selecting, further selects the second text file associated with the automatic performance data from among the text files stored in said first storage section; and wherein said display step display text data included in the selected second text file.

13. A computer-readable medium containing a program for causing a computer to perform a procedure for displaying music-related data in an electronic music apparatus capable of communicating with an external device that stores text files each including at least text data, said electronic music apparatus having a performance operator unit, a performance environment setting operator unit and a storage section, said electronic music apparatus generating a tone according to an operation of the performance operator unit and based on a performance environment set by the performance environment setting operator unit, said storage section storing registration data including predetermined performance environment setting information representative of a performance environment to be automatically set in association with the performance environment setting operator unit and text file selection information specifying a particular one of the text files, stored in the external device, which is associated with a performance environment represented by the performance environment setting information, said method comprising:

a step of selecting the registration data from said storage section;

a text acquisition step of, in accordance with the text file selection information of the registration data selected via said step of selecting, communicating with the external device to acquire any one of the text files stored in the external device; and a step of, on the basis of the text file acquired by said text acquisition step, displaying the text data included in the acquired text file, wherein said electronic music apparatus generates a tone based on the performance environment represented by the performance environment setting information.

14. An electronic music apparatus having a performance operator unit and a performance environment setting operator unit, said electronic music apparatus generating a tone according to an operation of the performance operator unit and based on a performance environment set by the performance environment setting operator unit, said electronic music apparatus comprising:

a first storage section that stores text files each including at least text data;

a second storage section that stores registration data including predetermined performance environment setting information representative of a performance environment to be automatically set in association with the performance environment setting operator unit and text file selection information specifying a text file associated with the performance environment represented by the performance environment setting information;

a third storage section that stores automatic performance data including lyrics data;

a selection section that selects registration data from said second storage section;

a text selection section that, in accordance with the text file selection information of the registration data selected via said selection section, selects the text file associated with the performance environment from among the text files stored in said first storage section;

a reproduction section that reproduces the automatic performance data stored in said third storage section;

a display section; and a display switching section that performs control to display, on said display section, the lyrics data included in the automatic performance data being reproduced by said reproduction section or the text data included in the text file selected via said text selection section, wherein said electronic music apparatus generates a tone according to the reproduced automatic performance data and based on the performance environment represented by the performance environment setting information.

15. An electronic music apparatus as claimed in claim 14 which further comprises a display control section that, during indication by said display section of the lyrics data or text data, controls the display by said display section while changing, per predetermined display unit, contents of the data to be displayed, and wherein, when the text data is being displayed during reproduction of the automatic performance data, said display control section changes the contents per said predetermined display unit irrespective of a progression of the automatic performance, while, when the lyrics data is being displayed during reproduction of the automatic performance data, said display control section does not change the contents per said predetermined display unit.

16. A method for displaying music-related data in an electronic music apparatus having a performance operator unit, a performance environment setting operator unit, a first storage section, a second storage section and a third storage section, said electronic music apparatus generating a tone according to an operation of the performance operator unit and based on a performance environment set by the performance environment setting operator unit, said first storage section storing text files each including at least text data; said second storage section storing registration data including predetermined performance environment setting information representative of a performance environment to be automatically set in association with the performance environment setting operator unit and text file selection information specifying a text file associated with the performance environment represented by the performance environment setting information, said third storage section storing automatic performance data including lyrics data, said method comprising:

a step of selecting registration data from said second storage section;

a text selection step of, in accordance with the text file selection information of the registration data selected via said step of selecting, selecting the text file associated with the performance environment from among the text files stored in said first storage section;

a step of reproducing the automatic performance data stored in said third storage section; and a step of displaying the lyrics data included in the automatic performance data being reproduced by said step of reproducing or the text data included in the text file stored in said first storage section, wherein said electronic music apparatus generates a tone according to the reproduced automatic performance data and based on the performance environment represented by the performance environment setting information.

17. A computer-readable medium containing a program for causing a computer to perform a procedure for displaying music-related data displaying music-related data in an electronic music apparatus having a performance operator unit, a performance environment setting operator unit, a first storage section, a second storage section and a third storage section, said electronic music apparatus generating a tone according to an operation of the performance operator unit and based on a performance environment set by the performance environment setting operator unit, said first storage section storing text files each including at least text data; said second storage section storing registration data including predetermined performance environment setting information representative of a performance environment to be automatically set in association with the performance environment setting operator unit and text file selection information specifying a text file associated with the performance environment represented by the performance environment setting information, said third storage section storing automatic performance data including lyrics data, said method comprising:

a step of selecting registration data from said second storage section;

a text selection step of, in accordance with the text file selection information of the registration data selected via said step of selecting, selecting the text file associated with the performance environment from among the text files stored in said first storage section;

a step of reproducing the automatic performance data stored in said third storage section; and a step of displaying the lyrics data included in the automatic performance data being reproduced by said step of reproducing or the text data included in the text file stored in said first storage section, wherein said electronic music apparatus generates a tone according to the reproduced automatic performance data and based on the performance environment represented by the performance environment setting information.

* * * * *